US006705786B2

(12) United States Patent
Trovinger

(10) Patent No.: US 6,705,786 B2
(45) Date of Patent: Mar. 16, 2004

(54) DUPLEX PRINTING OF PRINT SHEETS

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1 day.

(21) Appl. No.: 10/120,461

(22) Filed: Apr. 11, 2002

(65) Prior Publication Data

US 2003/0194253 A1 Oct. 16, 2003

(51) Int. Cl.[7] ..... B41J 13/22; B41J 13/00; B41J 3/60

(52) U.S. Cl. ..... 400/645.3; 400/645; 400/645.4; 271/184; 271/902

(58) Field of Search ..... 406/106; 399/364; 400/625, 634, 636, 642, 645, 645.3, 645.4; 271/902, 184

(56) References Cited

U.S. PATENT DOCUMENTS 5,708,954 A * 1/1998 Ando et al. ..... 399/402
5,730,533 A 3/1998 Noy et al. ..... 400/104
5,790,924 A 8/1998 Creutzmann et al. ..... 399/110
5,810,494 A * 9/1998 Menard et al. ..... 400/634
5,970,304 A 10/1999 Stemmle ..... 399/364
5,974,297 A 10/1999 Creutzmann et al. ..... 399/384
6,038,977 A 3/2000 Haney et al. ..... 101/490
6,160,985 A * 12/2000 Hou ..... 399/384
6,203,152 B1 3/2001 Boleda et al. ..... 347/102
6,244,183 B1 6/2001 Haney et al. ..... 101/490
6,247,802 B1 6/2001 Gasso ..... 347/85
6,290,410 B1 9/2001 Sunada et al. ..... 400/624

* cited by examiner

*Primary Examiner*—Daniel J. Colilla

(57) ABSTRACT

Systems and methods for duplex printing of print sheets are described. In one aspect, a duplex module is configured so that print sheets may be controllably and reliably re-introduced into a print module in an orientation that is suitable for marking the second side of the print sheet without requiring a support structure that spans the entire width of the print sheet. In large format printing applications, this feature avoids large and heavy support structures, such as feed rollers, that otherwise would be needed to support the print sheets, as well as their own weight. In this way, a printing apparatus may provide duplex printing functionality with a structure that has a relatively light weight and a relatively small overall footprint.

21 Claims, 7 Drawing Sheets

DUPLEX PRINTING OF PRINT SHEETS

TECHNICAL FIELD

This invention relates to systems and methods for duplex printing of print sheets.

BACKGROUND

Printing on two sides of a print sheet (or print media or image substrate), referred to as duplex printing, is a desirable feature in printing systems because, for example, it allows the amount of paper needed for a particular print task to be reduced as compared with one-sided (simplex) printing. Duplex printing also allows print sets with layouts resembling that of professionally printed books to be generated. Conventional duplex printing devices often employ complex paper handling mechanisms. For example, in accordance with one duplexing method, an extra tray is used for temporary storage of a stack of pre-cut print sheets having printing on a first side. When a set of first side copies is complete, the copies are fed out of the duplex tray and returned with an odd number of inversions along a duplex path to receive second side imaging. Alternatively, the first side copies may be returned along a second paper path to receive second side printing without stacking.

High speed printing by xerographic, ionographic, ink jet or other copiers, printers, plotters or other reproduction apparatus (encompassed herein by the terms "printer" and "printing apparatus") has become increasingly important and increasingly demanding in terms of quality, reliability, and other enhanced features, including full color and black and white printing functionality, and simplex and duplex printing functionality. High-speed printing machines typically print onto a web of sheet material, rather than using cut sheets as the copy sheets. The web of sheet material may be advanced from a roller through a printing module, which applies markings to the web of sheet material. Such roll feeding and printing systems may provide "two up" or "four up" (duplex signature) printing, in which dual page images are printed in side by side pairs on one or both sides of a wide web (or large format) dual page width web of sheet material.

In general, duplex printing on continuous web substrates is much more difficult than printing on cut sheets. One continuous web duplex printing approach uses multiple opposing print engines for respectively printing on opposite sides of the web (see, e.g., U.S. Pat. Nos. 3,940,210, 5,701,565, and 5,455,668). Such multiple print engine web printing duplex systems, however, typically are characterized by substantial size, cost, complexity and maintenance requirements. In another approach, U.S. Pat. No. 5,970,304 has proposed a continuous web substrate duplex printing system that utilizes a single xerographic print engine. Separate first and second image transfer stations are positioned in line with one another in the direction of movement of the endless surface imaging member. The second image transfer station is positioned downstream of the first image transfer station. Each image transfer station respectively transfers print images to the first and second sides of the continuous web sequentially without requiring a dual width imaging member or dual imaging members. The two inline transfer stations may be part of a dockable web printing module that is configured to feed the continuous web into the print engine for image transfers to both sides of the web with web inversion. The system includes a web loop in between the two transfer stations for transferring the page print images onto both sides of the web in the proper sequence and positions.

Still other duplex printing systems and methods have been proposed.

SUMMARY

The invention features systems and methods for duplex printing of print sheets in which print sheets may be controllably and reliably re-introduced into the print module in an orientation that is suitable for marking the second side of the print sheet without requiring a support structure that spans the entire width of the print sheet. In large format printing applications, the invention avoids large and heavy support structures, such as feed rollers, that otherwise would be needed to support the print sheets, as well as their own weight. In this way, the invention enables duplex printing apparatus of relatively light weight and a relatively small overall footprint to be implemented readily and in a cost effective manner.

In one aspect, the invention features a printing apparatus for marking first and second sides of a print sheet. The printing apparatus comprises a print module, a simplex module, and a duplex module. The print module is configured to mark one side of the print sheet at a time. The simplex module is configured to move the print sheet along a simplex feed path and to introduce the print sheet into the print module in an orientation suitable for marking the first side of the print sheet. The duplex module is configured to receive the print sheet from the print module. The duplex module also is configured to move the print sheet along a duplex feed path while clamping side edge regions of the print sheet and lo tensioning unsupported print sheet regions between the clamped side edge regions. In addition, the print module is configured to re-introduce the print sheet into the print module in an orientation suitable for marking the second side of the print sheet.

As used herein, the term "module" is intended to refer to a functional feature of a printing apparatus and is not intended to connote any particular structural implementation. For example, various modules of a printing apparatus may be incorporated into a single, unitary structure or they may be implemented as separable structural units that cooperate to perform one or more printing tasks.

Embodiments of the invention may include one or more of the following features.

In some embodiments, the duplex module comprises a print sheet handling assembly with sheet clamps mounted on respective rotatable arms. The rotatable arms may be configured to rotate about a common shaft. A first rotatable arm may have a fixed lateral position on the common shaft, and a second rotatable arm may have an adjustable lateral position on the common shaft to accommodate a width dimension of the print sheet.

In some embodiments, the print handling assembly of the duplex module comprises a cam surface system that is configured to control action of the sheet clamps during movement of the print sheet along the duplex feed path. The cam surface system may comprise a cam surface controlling separation of the sheet clamps during movement of the print sheet along the duplex feed path. The cam surface system also may comprise a cam surface controlling clamping of the sheet clamps when the print sheet is received from the print module and controlling unclamping of the sheet clamps from the side edge regions of the print sheet before the print sheet is re-introduced into the print module.

In some embodiments, the printing apparatus may be characterized by a footprint that is substantially smaller than the print sheet size.

The print module may comprise a sensor system that is configured to detect one or more holes in or edges of the print sheet for registering the first and second sides of the print sheet.

In another aspect, the invention features a printing apparatus having a duplex module that is configured to re-introduce the print sheet into the print module trailing edge first in an orientation suitable for marking the second side of the print sheet.

In another aspect, the invention features a printing method for marking first and second sides of a print sheet. In accordance with this inventive method, the print sheet is moved along a simplex feed path. The print sheet is introduced into a print module in an orientation suitable for marking the first side of the print sheet. The print sheet is received from the print module. The print sheet is moved along a duplex feed path while clamping side edge regions of the print sheet and tensioning unsupported print sheet regions between the clamped side edge regions. The print sheet is re-introduced into the print module in an orientation suitable for marking the second side of the print sheet.

In another aspect, the invention features a printing method for marking first and second sides of a print sheet. In accordance with this inventive method, the print sheet is moved along a simplex feed path. The print sheet is introduced into a print module in an orientation suitable for marking the first side of the print sheet. The print sheet is received from the print module. The print sheet is reintroduced into the print module trailing edge first in an orientation suitable for marking the second side of the print sheet.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
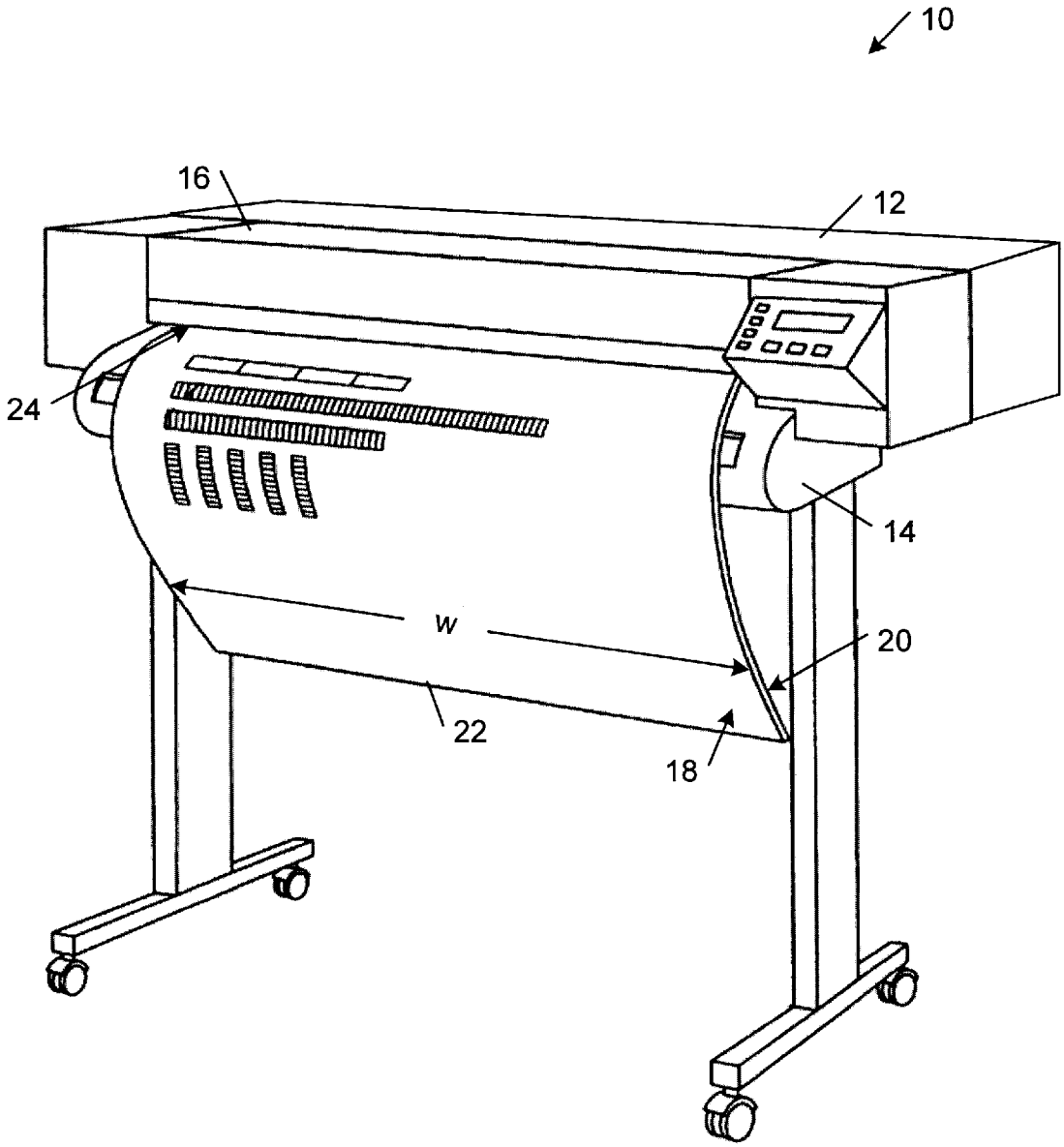
FIG. 1 is a diagrammatic perspective view of a printing apparatus that includes a print module, a simplex module, and duplex module.

Referring to FIG. 1, in one embodiment, a printing apparatus 10 includes a print module 12, a simplex module 14, and a duplex module 16 that are configured to cooperatively provide simplex and duplex printing functionality, which enables one or both sides 18, 20 of a print sheet 22 to be marked. Printing apparatus 10 may be implemented as any one of a wide variety of different printing machines, including xerographic, ionographic, ink jet or other copiers, printers, plotters or other reproduction apparatus. In the illustrated embodiment, printing apparatus 10 is shown as a large format, high performance graphics printer. Print sheet 22 may be introduced into printing apparatus as a pre-cut sheet of print media or it may be introduced from a roll of web sheet media. In the illustrated embodiment, print sheet 22 is shown as a large format sheet of material. As used herein, the term "large format" is intended to refer broadly to print sheets having a width (w) that is greater than approximately 28 cm (11 inches). Conventional large format print sheets have typical widths in the range of about 46 cm (18 inches) to about 61 cm (24 inches); although some large format print sheets have widths up to about 152 cm (60 inches), or greater.

In a simplex mode of operation, print sheet 22 is moved along a simplex feed path and introduced into print module 12 in an orientation that is suitable for marking the first side 18 of print sheet 22. In a duplex mode of operation, after the first side 18 of print sheet 22 has been marked, print sheet 22 is moved along a duplex feed path and re-introduced into print module 12 in an orientation that is suitable for marking the second side 20 of print sheet 22. The print sheet 22 may be fed into printing apparatus 10 through an input feed slot (not shown) and may be fed out printing apparatus 10 through an output feed slot 24. In other embodiments, print sheet 22 may be fed into and out of the same feed slot.

As explained in detail below, duplex module 16 is configured so that print sheets may be controllably and reliably re-introduced into the print module 12 in an orientation that is suitable for marking the second side 20 of print sheet 22 without requiring a support structure that spans the entire width of the print sheet. In large format printing applications, this feature avoids large and heavy support structures, such as feed rollers, that otherwise would be needed to support the print sheets, as well as their own weight. In this way, printing apparatus 10 may provide duplex printing functionality with a structure that has a relatively light weight and a relatively small overall footprint.

As explained in connection with FIGS. 2A–2D, in one embodiment, duplex module 16 is configured to receive a print sheet from the print module 12, and to re-introduce the print sheet into the print module 12, trailing edge first and in an orientation that is suitable for marking the second side 20 of the print sheet.

Figure 2A:
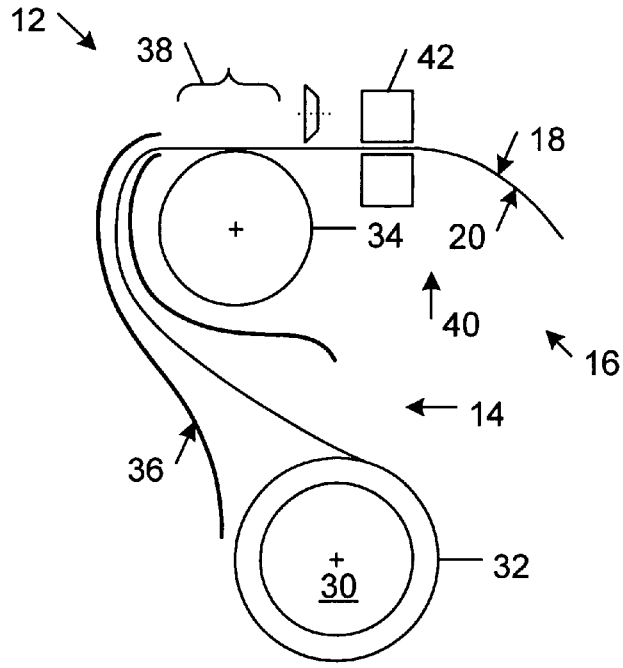
FIG. 2A is a diagrammatic side view of a print sheet web moving along a simplex feed path and being introduced into a print module in an orientation suitable for marking a first side of the print sheet.

Referring initially to FIG. 2A, print sheets are fed into printing system 10 from a web of sheet material (or print sheet web) 32 that is mounted on a roller 30. Simplex module 14 may include a conventional feed mechanism (e.g., conventional friction rollers, pinch wheels, and overdrive wheels; not shown) that engages with a main drive roller 34 to feed the web of sheet material 32 along a simplex feed (or guide) path 36. The simplex feed path 36 guides the web of sheet material 32 to a print zone 38 inside print module 12. One side edge of the web of sheet material 32 preferably is registered against a reference edge (not shown). As the first side 18 of the web of sheet material 32 is being marked by print module 12, the web of sheet material is guided to a print sheet handling assembly 40 of duplex module 16. Print sheet handling assembly 40 includes sheet clamps 42 that are configured to receive the web of sheet material 32 from print module 12. Sheet clamps may include conventional pinch rollers or other conventional sheet clamping mechanisms.

Figure 2B:
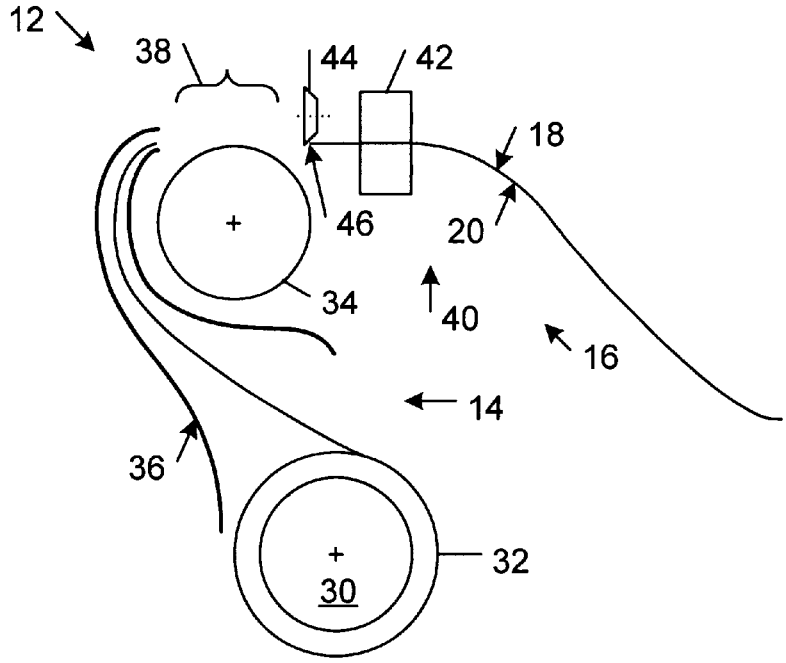
FIG. 2B is a diagrammatic side view of the print sheet web of FIG. 2A having a trailing edge formed by cutting the print sheet web in a transverse direction while being clamped at side edge regions.

As shown in FIG. 2B, after the first side 18 of the web of sheet material 32 has been marked by print module 12, the web of sheet material 32 is advanced into the print sheet handling assembly 40. Sheet clamps 42 hold onto side edge regions of the web of sheet material. A cutter 44 (or slitter) cuts the web of sheet material 32 to a specified length to form a trailing edge 46 of print sheet 22. After the web of sheet material 32 has been cut, the simplex feed mechanism may retract the web of sheet material 32 out of the print zone 38 and into simplex module 14.

Figure 2C:
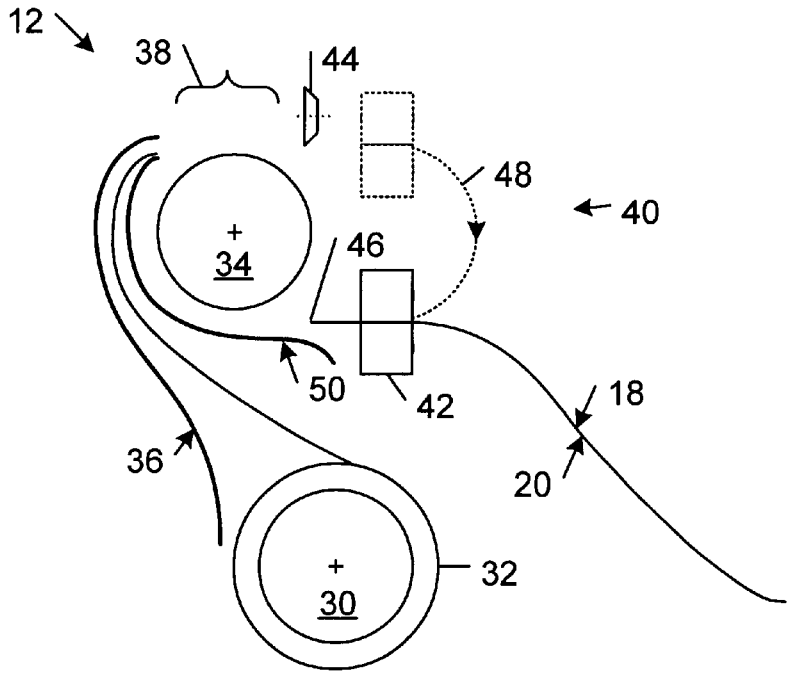
FIG. 2C is a diagrammatic side view of the cut print sheet of FIG. 2B being moved along a duplex feed path with unsupported regions between the clamped side edge regions being tensioned.

Referring to FIG. 2C, sheet clamps 42 are mounted on respective rotatable arms (not shown), which carry sheet clamps 42—and print sheet 22—along a first duplex feed path 48. While print sheet 22 is being moved along first duplex feed path 48, sheet clamps 42 tension unsupported print sheet regions between the clamped side edge regions. In this way, print sheet 22 may be controllably and reliably re-introduced into the print module 12 in an orientation that is suitable for marking the second side 20 of print sheet 22 without requiring a support structure that spans the entire width of the print sheet. Print handling assembly 40 introduces the trailing edge 46 of print sheet 22 into a second duplex feed (or guide) path 50 of duplex module 16.

Figure 2D:
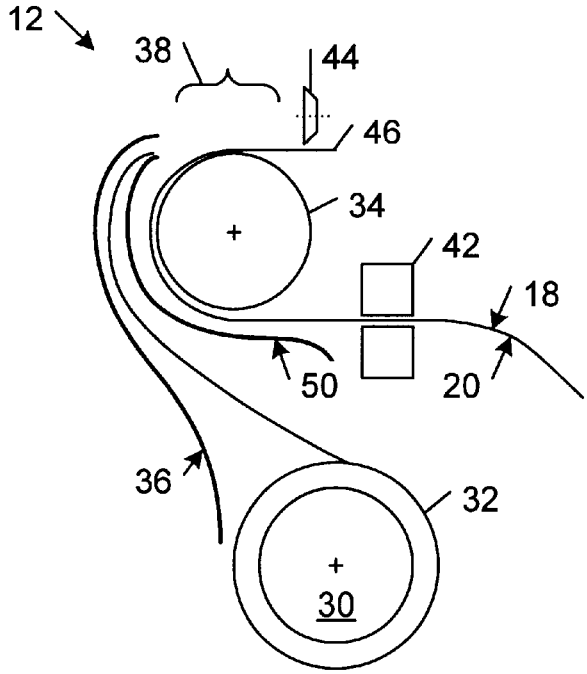
FIG. 2D is a diagrammatic side view of the print sheet of FIG. 2C being reintroduced into the print module in an orientation suitable for marking the second side of the print sheet.

Referring to FIG. 2D, duplex module 16 may include a conventional feed mechanism (e.g., conventional friction rollers, pinch wheels, and overdrive wheels; not shown) that engages with main drive roller 34 to feed print sheet 22 along second duplex feed path 50. After the feed mechanism of duplex module 16 has engaged the trailing edge 46 of print sheet 22, sheet clamps 42 release print sheet 22 so that the duplex feed mechanism may feed print sheet 22 along duplex path 50. The second duplex feed path 50 guides the trailing edge 46 of print sheet 22 to print zone 38, where the second side 20 of print sheet 22 is marked. The second side 20 of print sheet 22 may be registered with the first side 18 by measuring the skew of the trailing edge 46 and the position of a side edge of print sheet 22 as it is being fed into second duplex feed path 50. Conventional optical sensors may be used to measure the edge skew and edge position of print sheet 22. Some embodiments may include a sensor system that is configured to detect one or more holes in print sheet 22 for registering first and second sides 18, 20 of print sheet 22. The holes may be formed by a hold punch mechanism in printing apparatus 10. Holes may be located in pre-designated side margin areas of print sheet 22 or in a center region of print sheet 22, or both.

Figure 3A:
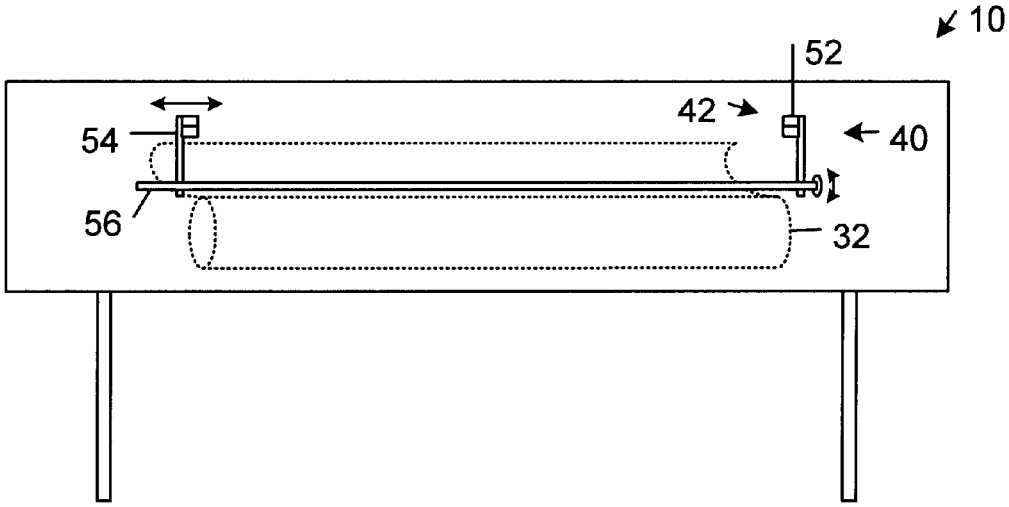
FIG. 3A is a diagrammatic cross-sectional front view of a print sheet handling assembly of the printing apparatus of FIG. 1 with sheet clamps mounted on respective rotatable arms.
Figure 3B:
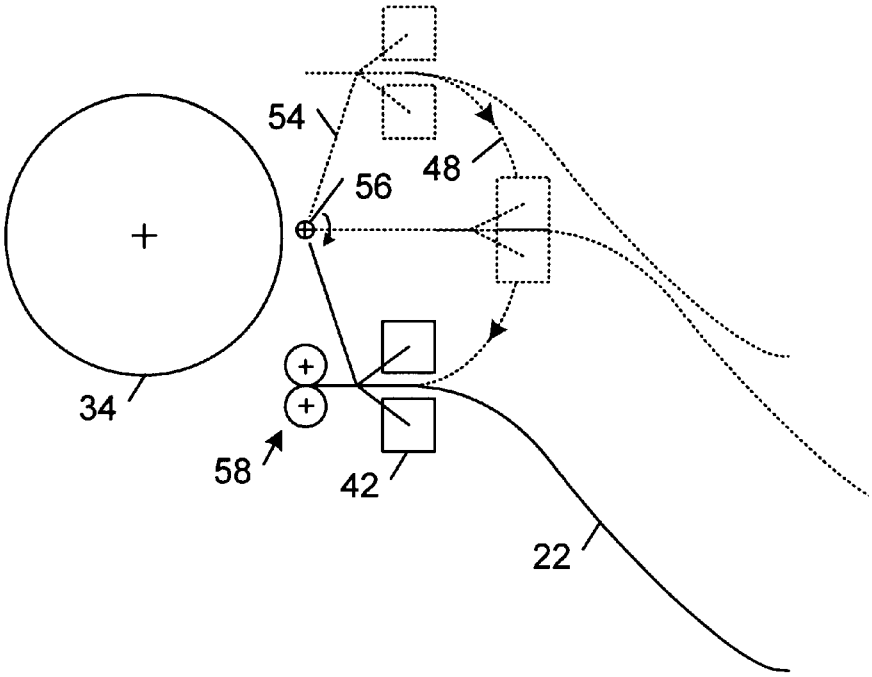
FIG. 3B is a diagrammatic side view of a print sheet handling assembly with rotatable arms and sheet clamps shown at different points along a duplex feed path.

As shown in FIGS. 3A and 3B, sheet clamps 42 of print handling assembly 40 may be mounted on a pair of rotatable arms 52, 54. Each rotatable arm 52, 54 may be mounted on a spline shaft 56. In the illustrated embodiment, the lateral position of one arm 52 may be fixed adjacent to the reference edge (not shown) against which one side of print sheet 22 preferably is registered, and the lateral position of the other arm 54 may be moved to different locations along spine shaft 56 to accommodate different widths of the web of sheet material 32. In other embodiments, both arms 52, 54 may be adjusted laterally to accommodate center-justified rolls. As shown in FIG. 3B, rotatable arms 52, 54 may rotate about spline shaft 56 to controllably position sheet clamps 42 along first duplex feed path 48. Rotatable arm 54 may be positioned and driven from any point across the length of spline shaft 56. Rotatable arms 52, 54 may each may include a spring or other biasing member that is configured to balance tension as rotatable arms 52, 54 move sheet clamps 42 and print sheet 22 along first duplex feed path 48. By providing a flexure against tension, the springs reduce risk of tearing or scratching print sheet 22 as it is moved along first duplex feed path 48.

Duplex module 16 may be configured so that a single motor and drive apparatus may control the duplexing functionality of printing apparatus 10. In particular, an existing internal motor, such as the motor powering main drive roller 34, may be engaged by the feed mechanism 58 and the spline shaft 56 of duplex module 16 through conventional clutching mechanisms. Sheet clamps 42 may be opened and closed by a special position of the print head of print module 12 or by a separate armature assembly.

Figure 4A:
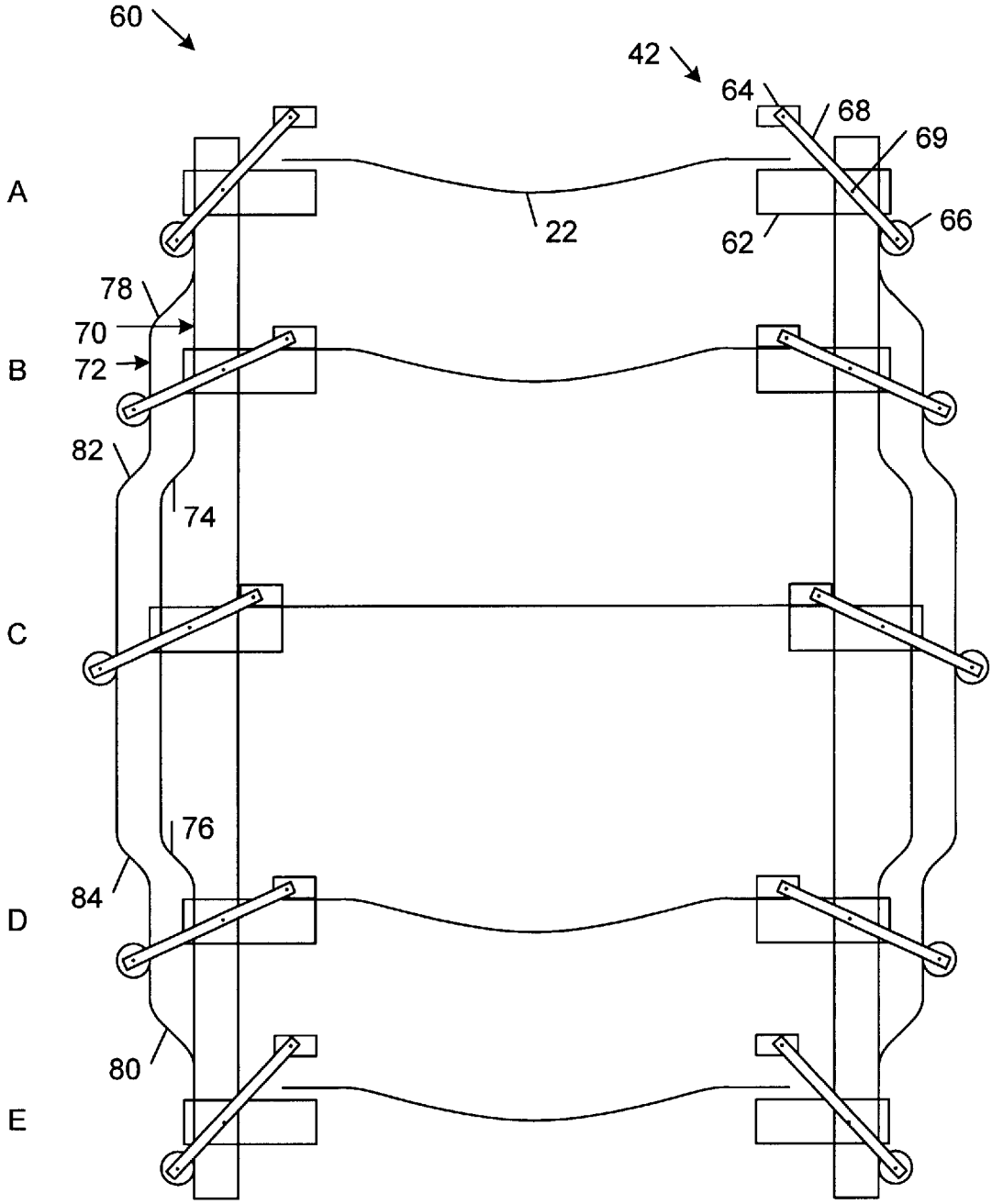
FIG. 4A is a diagrammatic front view of a print sheet handling assembly with rotatable arms and sheet clamps shown at different points along a duplex feed path defined by a cam surface system.
Figure 4B:
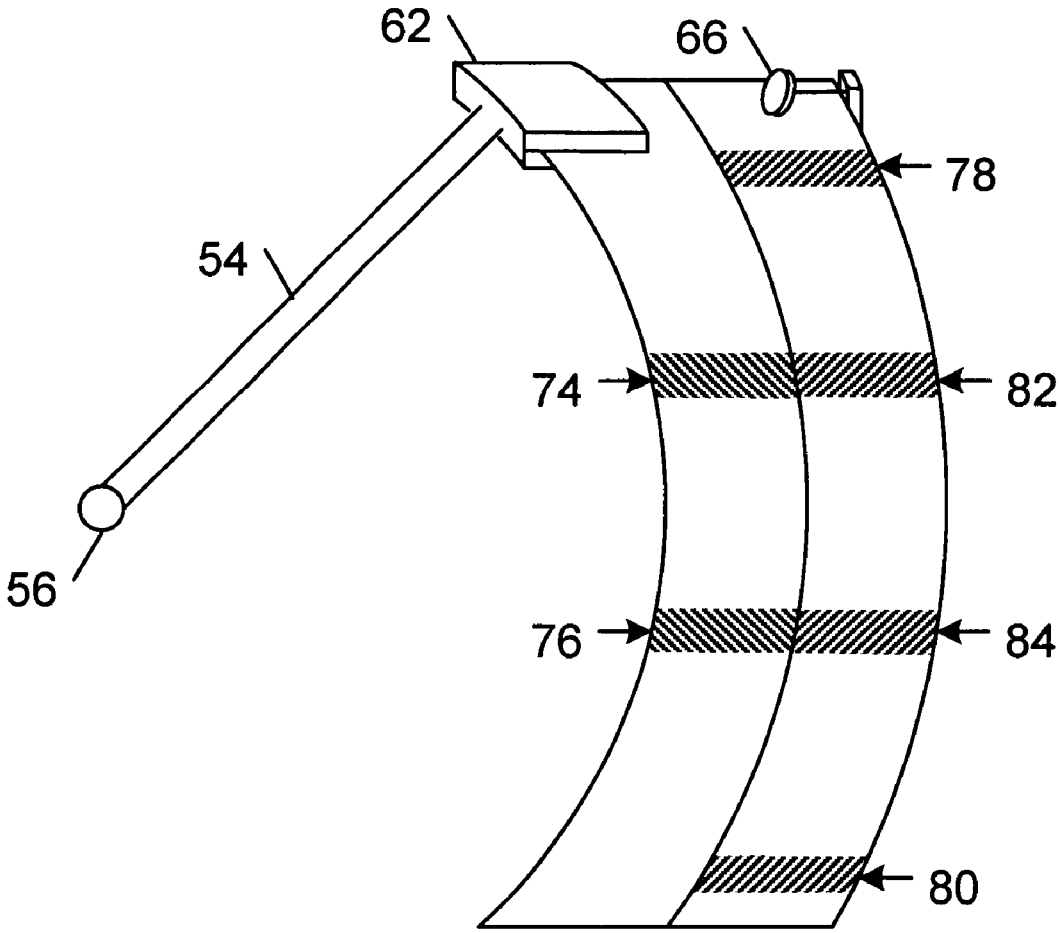
FIG. 4B is a diagrammatic view of the cam surface system of FIG. 4A.

Referring to FIGS. 4A and 4B, in another embodiment, a respective cam surface system 60 may be used to control action of each sheet clamp 42 during movement of print sheet 22 along first duplex feed path 48. In this embodiment, each sheet clamp 42 includes a tensioning member 62 and a clamping member 64 that is coupled to a follower wheel 66 by a shaft 68. Shaft 68 may rotate about a pivot pin 69, which is attached to tensioning member 62. Each sheet clamp 42 also includes a biasing member (e.g., a spring; not shown) that is configured to urge clamping member 64 away from tensioning member 62 (i.e., an open position). Each cam surface system 60 includes a tensioning cam surface 70 and a clamping cam surface 72. The tensioning cam surface 70 includes a tensioning ramp 74 and a relaxation ramp 76. The clamping cam surface 72 includes a clamping ramp 78 and an unclamping ramp 80. The clamping cam surface also includes a pair of follower ramps 82, 84, which track the surface variations of tensioning ramp 74 and relaxation ramp 76, respectively.

In operation, tensioning member 62 slides over tensioning cam surface 70 and the follower wheel 66 of clamping member 64 slides over clamping cam surface 72. Sheet clamps 42 initially receive print sheet 22 from print module 12 in an open position on cam surface systems 60 (position A). In this position, the spring force of the biasing member of each sheet clamp is sufficient to hold clamping member 64 in an open position and, thereby, enable print sheet 22 to pass between tensioning member 62 and clamping member 64. In large format print sheet applications, the relatively large width of print sheet 22 tends to cause unsupported regions near the center of the print sheet to sag slightly, as shown. As rotatable arms 52, 54 drive sheet clamps 42 along duplex path 48, the follower wheel 66 associated with each clamping member 64 first engages clamping ramp 78. This causes shaft 68 to rotate about pivot pin 69 and clamping member 64 to close down on a side edge region of print sheet 22, holding it in place against tensioning member 62 (position B). Next, tensioning member 62 engages tensioning ramp 74 and follower wheel 66 engages follower ramp 82. This causes the sheet clamps to separate and, thereby, tensions unsupported print sheet regions between the sheet clamps (position C). As the sheet clamps 42 approach the unloading station near the entrance to the second duplex feed path 50, tensioning member 62 engages relaxation ramp 76 and follower wheel 66 engages follower ramp 84. This causes the sheet clamps to move closer together and, thereby, relaxes unsupported print sheet regions between the sheet clamps (position D). Print sheet 22 may be unloaded after the duplex feed mechanism engages trailing edge 46 of print sheet 22 and the follower wheel 66 engages unclamping ramp 80, enabling the spring force of the biasing member of each sheet clamp 42 to place clamping member 64 in an open position (position E).

Figure 5A:
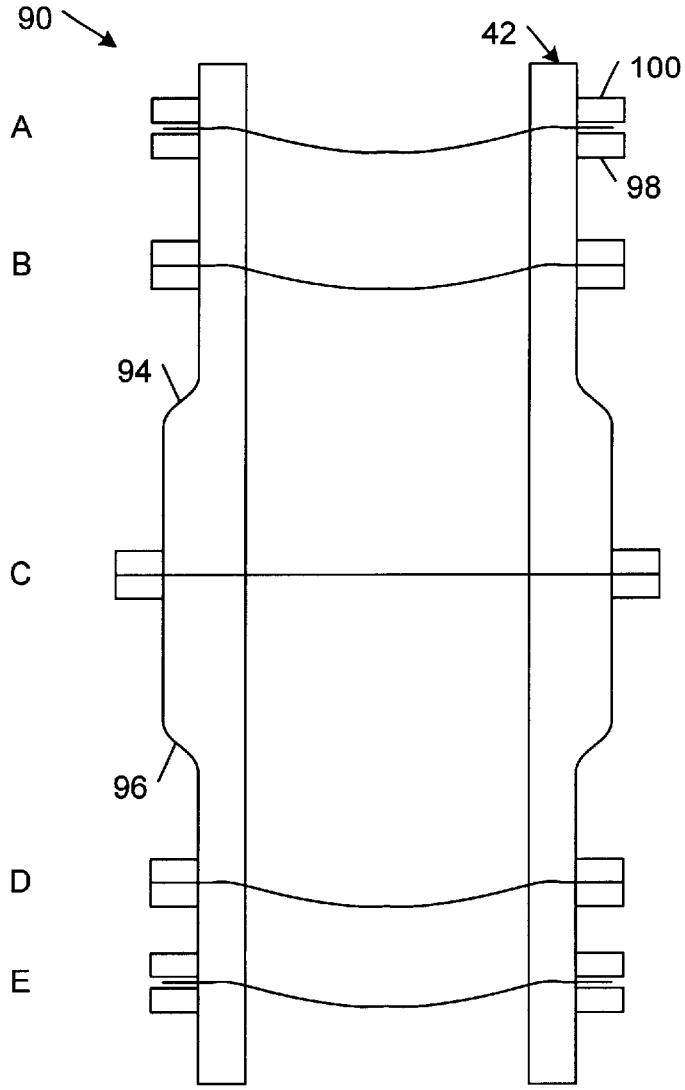
FIG. 5A is a diagrammatic front view of a print sheet handling assembly with sheet clamps shown at different points along a duplex feed path defined by a cam surface system.
Figure 5B:
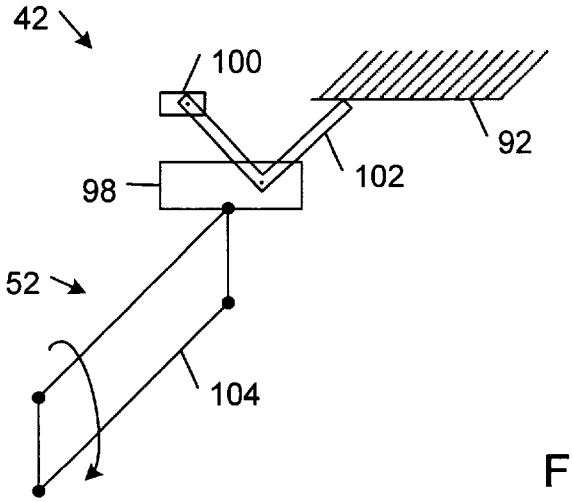
FIG. 5B is a diagrammatic view of a sheet clamp and a rotatable arm of the print sheet handling system of FIG. 5A.

Referring to FIGS. 5A and 5B, in another embodiment, the tensioning of print sheet 22 may be controlled by a cam surface system 90 and the clamping action of each sheet clamp 42 may be controlled by a stop 92. Cam surface system 90 includes a tensioning ramp 94 and a relaxation ramp 96, and is similar in construction to tensioning cam surface 70 of cam surface system 60. Each sheet clamp 42 includes a tensioning member 98, a clamping member 100 and a biasing member (not shown), and is similar in construction to the sheet clamp in the embodiment of FIGS. 4A and 4B, except that the associated shaft 102 is configured to engage stop 92 and the biasing member is configured to urge clamping member 100 into a closed position. In this embodiment, rotatable arms 52, 54 include a four-bar linkage mechanism 104, which is configured to maintain the alignment of sheet clamps 42 over the entire range of duplex feed path 48. Stop 92 is located at the loading and unloading positions along duplex feed path 48.

In operation, tensioning member 98 slides over cam surface system 90. Sheet clamps 42 initially receive print sheet 22 from print module 12 in an open position on cam surface systems 90 (position A). In this position, the engagement between shaft 102 and stop 92 is sufficient to overcome the spring force of the biasing member of each sheet clamp and hold clamping member 100 in an open position, enabling print sheet 22 to pass between tensioning member 98 and clamping member 100. In large format print sheet applications, the relatively large width of print sheet 22 tends to cause unsupported regions near the center of the print sheet to sag slightly, as shown. As rotatable arms 52, 54 drive sheet clamps 42 along first duplex path 48, shaft 102 disengages from stop 92 and the spring force of the biasing member of each sheet clamp is sufficient to cause clamping member 100 to close down on a side edge region of print sheet 22, holding it in place against tensioning member 98 (position B). Next, tensioning member 98 engages tensioning ramp 94. This causes the sheet clamps to separate and, thereby, tensions unsupported print sheet regions between the sheet clamps (position C). As the sheet clamps 42 near the unloading station near the entrance to the duplex feed path 50, tensioning member 98 engages relaxation ramp 96. This causes the sheet clamps to move closer together and, thereby, relaxes unsupported print sheet regions between the sheet clamps (position D). Print sheet 22 may be unloaded after the duplex feed mechanism engages trailing edge 46 of print sheet 22 and shaft 102 engages stop 92, which overcomes the spring force of the biasing member of each sheet clamp 42 and places clamping member 100 in an open position (position E).

Other embodiments are within the scope of the claims. For example, in some embodiments, the leading edge of print sheet 22 may be re-introduced into print module 12 rather the trailing edge 46. In these embodiments, sheet clamps 42 may hold onto side edge regions near the leading edge of print sheet 22. After the first side 18 of the web of sheet material 32 has been marked by print module 12 and the web of sheet material 32 has been cut to a specified length by cutter 44, sheet clamps may move the print sheet over an inverting duplex feed path. The inverting duplex feed path is configured so that print sheet 22 may be reintroduced into print module 12 leading edge first and in an orientation that is suitable for marking the second side 20 of print sheet 22. In some embodiments, the inverting duplex feed path may extend, for example, over the top of printing apparatus 10. In other embodiments, the inverting duplex feed path may extend within the housing of printing apparatus 10.

Still other embodiments are within the scope of the claims.

What is claimed is:

1. A printing apparatus for marking first and second sides of a print sheet, comprising:

a print module configured to mark one side of the print sheet at a time;

a simplex module configured to move the print sheet along a simplex feed path and to introduce the print sheet into the print module in an orientation suitable for marking the first side of the print sheet; and a duplex module configured to receive the print sheet from the print module, to move the print sheet along a duplex feed path while clamping side edge regions of the print sheet and tensioning unsupported print sheet regions between the clamped side edge regions, and to re-introduce the print sheet into the print module in an orientation suitable for marking the second side of the print sheet.

2. The printing apparatus of claim 1, wherein the duplex module comprises a print sheet handling assembly with sheet clamps mounted on respective rotatable arms.

3. The printing apparatus of claim 2, wherein each of the rotatable arms is configured to rotate about a common shaft.

4. The printing apparatus of claim 3, wherein a first rotatable arm has a fixed lateral position on the common shaft and a second rotatable arm has an adjustable lateral position on the common shaft to accommodate a width dimension of the print sheet.

5. The printing apparatus of claim 2, wherein the print handling assembly of the duplex module comprises a cam surface system configured to control action of the sheet clamps during movement of the print sheet along the duplex feed path.

6. The printing apparatus of claim 5, wherein the cam surface system comprises a cam surface controlling separation of the sheet clamps during movement of the print sheet along the duplex feed path.

7. The printing apparatus of claim 5, wherein the cam surface system comprises a cam surface controlling clamping of the sheet clamps when the print sheet is received from the print module and controlling unclamping of the sheet clamps from the side edge regions of the print sheet before the print sheet is re-introduced into the print module.

8. The printing apparatus of claim 1, wherein the duplex module is configured to clamp side edge regions near a trailing edge of the print sheet received from the print module.

9. The printing apparatus of claim 8, wherein the duplex module is configured to re-introduce the print sheet into the print module trailing edge first.

10. The printing apparatus of claim 9, characterized by a footprint substantially smaller than the print sheet size.

11. The printing apparatus of claim 1, wherein the print module comprises a sensor system configured to detect one or more holes in the print sheet for registering the first and second sides of the print sheet.

12. The printing apparatus of claim 1, wherein the print module comprises a sensor system configured to detect one or more edges of the print sheet for registering the first and second sides of the print sheet.

13. The printing apparatus of claim 1, wherein the duplex module is configured to re-introduce the print sheet into the print module trailing edge first in an orientation suitable for marking the second side of the print sheet.

14. A printing apparatus for marking first and second sides of a print sheet, comprising:

a print module configured to mark one side of the print sheet at a time;

a simplex module configured to move the print sheet along a simplex feed path and to introduce the print sheet into the print module in an orientation suitable for marking the first side of the print sheet; and a duplex module configured to receive the print sheet from the print module, and to re-introduce the print sheet into the print module trailing edge first in an orientation suitable for marking the second side of the print sheet, wherein the duplex module comprises a print sheet handling assembly with sheet clamps mounted on respective rotatable arms and configured to clamp side edge regions near a trailing edge of the print sheet received from the print module.

15. The printing apparatus of claim 14, wherein the print handling assembly of the duplex module comprises a cam surface system configured to control action of the sheet clamps during movement of the print sheet along the duplex feed path.

16. The printing apparatus of claim 15, wherein the cam surface system comprises a cam surface controlling separation of the sheet clamps during movement of the print sheet along the duplex feed path.

17. The printing apparatus of claim 15, wherein the cam surface system comprises a cam surface controlling clamping of the sheet clamps when the print sheet is received from the print module and controlling unclamping of the sheet clamps from the side edge regions of the print sheet before the print sheet is re-introduced into the print module.

18. A printing method for marking first and second sides of a print sheet, comprising:

moving the print sheet along a simplex feed path;

introducing the print sheet into a print module in an orientation suitable for marking the first side of the print sheet;

receiving the print sheet from the print module;

moving the print sheet along a duplex feed path while clamping side edge regions of the print sheet and tensioning unsupported print sheet regions between the clamped side edge regions; and re-introducing the print sheet into the print module in an orientation suitable for marking the second side of the print sheet.

19. The printing method of claim 18, wherein the print sheet is moved over a cam surface system configured to control clamping of the side edge regions of the print sheet during movement of the print sheet along the duplex feed path.

20. The printing method of claim 19, wherein the cam surface system is further configured to control tensioning of the side edge regions of the print sheet during movement of the print sheet along the duplex feed path.

21. The printing method of claim 18, wherein the print sheet is re-introduced into the print module trailing edge first in the orientation suitable for marking the second side of the print sheet.

* * * * *